United States Patent [19]

Dunnagan

[11] Patent Number: 4,713,884

[45] Date of Patent: Dec. 22, 1987

[54] CARPET PAD KNIFE

[76] Inventor: Cecil A. Dunnagan, 313 Witherspoon, Gallatin, Tenn. 37066

[21] Appl. No.: 904,208

[22] Filed: Sep. 8, 1986

[51] Int. Cl.[4] ..... B26B 29/00

[52] U.S. Cl. ..... 30/294; 30/317; 30/339

[58] Field of Search ..... 30/294, 337, 329, 342, 30/314, 317, 339

[56] References Cited

U.S. PATENT DOCUMENTS

| | | | |
|---|---|---|---|
| 2,566,493 | 9/1951 | Ladd | 30/339 UX |
| 2,679,100 | 5/1954 | Ehler | 30/294 X |
| 2,853,778 | 9/1958 | Pratt et al. | 30/294 |
| 4,373,263 | 2/1983 | Ayers | 30/294 |

*Primary Examiner*—Douglas D. Watts

*Attorney, Agent, or Firm*—Pitts and Brittian

[57] ABSTRACT

A hand held knife for use in cutting carpet pads. A speciality type utility knife used principally for cutting carpet pads has a handle configured such that a straight edged cutting blade releasably held in the handle provides a slicing action in contrast to a cutting action on the carpet pad. The knife unit is fabricated with two substantially mirror image halves which are divided at a median plane. A thumbwheel rotatably mounted in one of the halves and threadably engaged with the second half permits the ready separation of the two halves a distance necessary for rotation of one-half with respect to the other for the removal of a knife blade from an internal storage compartment and its insertion in the proper cutting position. Because of the simplicity of the separation of the components and the slicing action of the knife blade, fatigue to a user of this device is substantially reduced.

8 Claims, 10 Drawing Figures

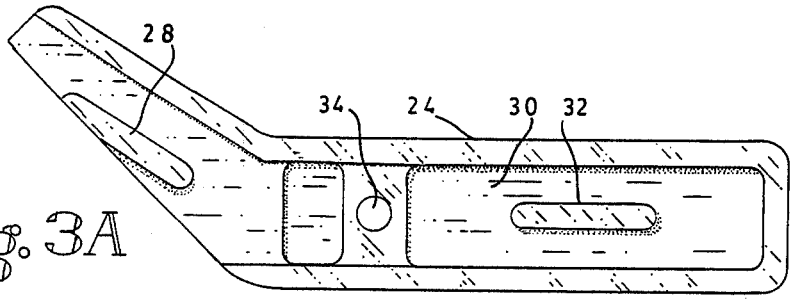
Fig. 3A
Fig. 3B
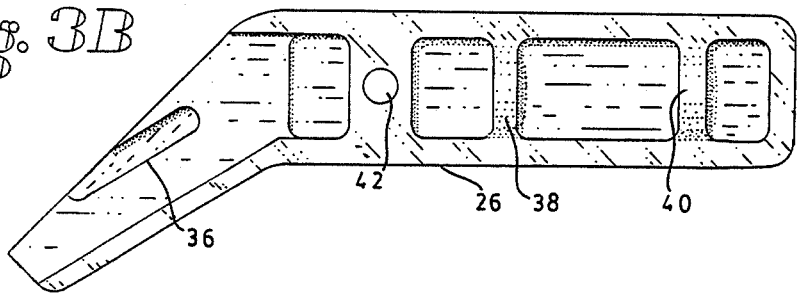
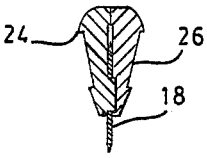
Fig. 4
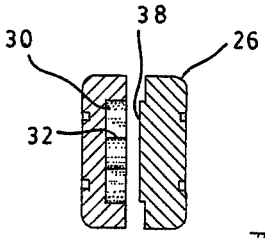
Fig. 5
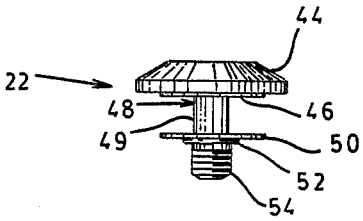
Fig. 6
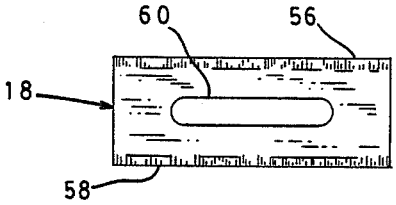
Fig. 7

CARPET PAD KNIFE

DESCRIPTION

1. Technical Field

This invention relates generally to hand held cutting implements, and more particularly to a hand held knife for use in cutting the various types of pads used under carpeting. It is designed for use by carpet installers, and results in a slicing action of the pad in contrast to the cutting action of the prior art devices.

2. Background Art

In the tool art there are numerous types of hand held cutting implements that utilize a replaceable blade in one end thereof with an internal storage of additional blades. These knives have a pair of handle members generally abutting at a median plane which are held together by a releasable fastener such that a blade is clamped between the halves in a cutting position. Also, the handle halves conventionally have a storage region that is utilized to hold additional blades. The two halves are typically held together with a bolt and a nut which requires the use of a screwdriver or like instrument for separating the two halves of the handle.

Carpet pad knives have been structured utilizing this general principle that has been used in the other so-called "utility" knives. In these prior art carpet pad knives, the replaceable cutting blade is essentially an extension of the handle such that the cutting edge of the blade is usually at an angle of 30 to 45 degrees with respect to the carpet pad during the cutting operation. The carpet pad is extremely flexible and when this type of blade is utilized for cutting, even when the blade is extremely sharp, the carpet pad is caused to wrinkle and considerable effort is needed to cut through the pad.

Still another type of carpet knife utilizes a blade having an arcuate cutting surface, a portion of which is at a substantial angle to the surface of the carpet pad. This type of knife also causes a wrinkling of the carpet pad with accompanying increase in the effort required for cutting. Furthermore, these knives which cause a wrinkling of the carpet pad often produce a rather inaccurate cut, particularly when an accurate cut is required around doorways and the like. The effort needed to use these knives of the prior art adds fatigue to a carpet pad installer.

Accordingly, it is a principle object of the present invention to provide a carpet pad knife which will orient the cutting edge of the blade so as to achieve accurate cutting of the carpet pad without the attendant wrinkling thereof.

It is a further object of the present invention to provide means for readily separating the handle components for the replacement of the blade.

It is still another object of the present invention to provide a carpet pad knife with a reservoir for extra cutting blades, said reservoir being more readily accessable than that of the prior art.

It is also another object to provide a carpet pad knife that reduces the time and effort involved in the installation of carpet pads.

These and other objects of the present invention will become apparent upon consideration of the accompanying drawings and the detailed description which follow.

DESCRIPTION OF THE INVENTION

In accordance with the present invention, there is provided a carpet pad knife which holds the cutting blade at a very small angle (substantially parallel) to the plane of the carpet pad such that a slicing action is utilized for the cutting. This produces a very clean cut with substantially no wrinkling, and the sharp edge of the blade is retained for a longer period of time. The time and effort involved in cutting of the carpet pad are reduced. Furthermore, a thumbwheel is readily accessable to the user to separate the two halves of the handle sufficiently such that blades are readily replaced and further provides ready access to the storage compartment within the handle.

BRIEF DESCRIPTION OF THE DRAWINGS

FIG. 3A is a drawing showing the interior surface of the left hand portion of the carpet pad knife handle of FIG. 1.

FIG. 3B is an inside view of the right hand handle portion of the carpet pad knife of FIG. 1.

FIG. 4 is a cross-sectional drawing of the forward portion of the present carpet pad knife taken at 4—4 of FIG. 1.

FIG. 5 is a cross-sectional view of the handle portion of the carpet pad knife of FIG. 1 taken at 5—5 thereof.

FIG. 6 is a side elevational view of the thumbwheel and its associated components as used in the carpet pad knife of FIG. 1.

FIG. 7 is a side elevational view of a typical (conventional) blade used in the carpet pad knife of FIG. 1.

BEST MODE FOR CARRYING OUT THE INVENTION

Figure 1:
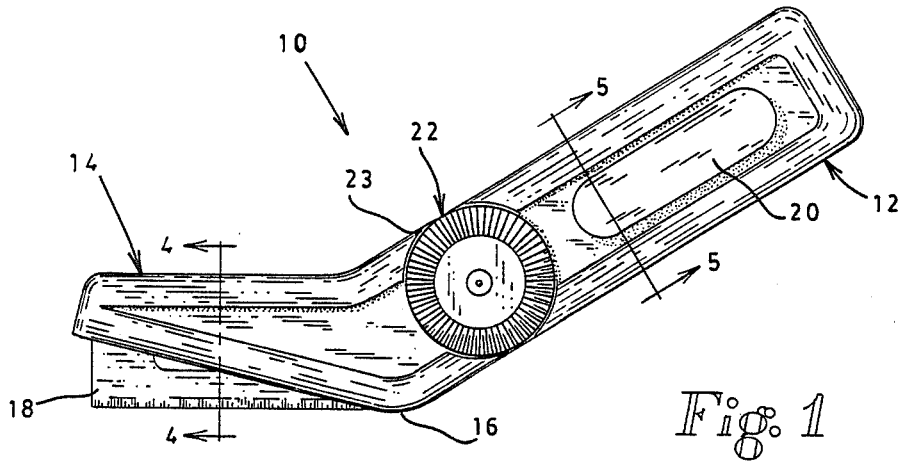
FIG. 1 is a side elevational view of a carpet pad knife according to the present invention.

Referring now to FIG. 1, shown therein at 10 is a side elevational view of a carpet pad knife of the present invention. This knife has a handle portion 12 with a forwardly projecting blade support portion 14 formed at generally an angle of 30 to 45 degrees with respect to the long dimension of the handle 12. There is a heel 16 at the transition between the two portions 12 and 14, the purpose of which will be described hereinafter. A knife blade 18 of the type shown in FIG. 7 is clamped in the forward projection 14 as shown. The aforementioned angle between the handle portion 12 and the forward portion 14 is selected such that the handle portion 12 is easily gripped by a user when the cutting edge of the blade 18 is substantially along the surface of a carpet pad (see FIG. 9). The handle 12 can be provided with various ornamentation 20 (ridges and valleys) which also functions to assist in the grasp of the handle by the user. Also seen in this figure is a thumbwheel 22 which will be described in more detail hereinafter. This thumbwheel can be partially recessed into the exterior of the handle as at 23 and the edge thereof extends to at least an upper edge of the handle portion 12 to be readily accessible to the user.

Figure 2:
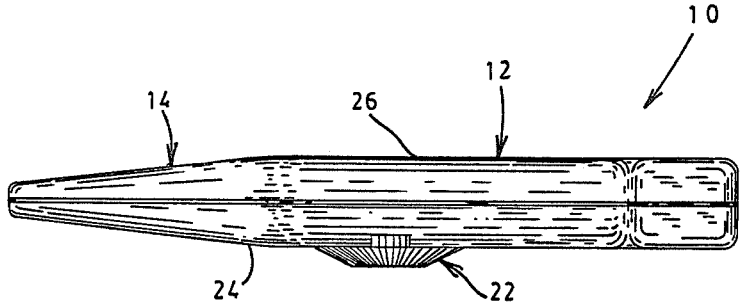
FIG. 2 is a top view of the carpet pad knife that is shown in FIG. 1.

A top view of the present carpet pad knife is shown in FIG. 2. It can be seen that the handle portion 12 and the blade support portion 14 are made up of a left hand portion 24 and a right hand portion 26. These two portions are held together by action of the thumbwheel 22. The right hand portion and the left hand portion are substantially mirror images of each other as will be described with respect to FIG. 3.

Referring now to FIG. 3A, shown therein is the inside surface of the right hand portion 24 of the handle 12 and its extension 14. It can be seen that the extension 14 is provided with a raised boss 28 which is sized to be received in a longitudinal slot provided in conventional blades as shown in FIG. 7. This boss 28 establishes the angle of the blade edge with respect to the holder 10. Furthermore, the handle portion 12 is provided with a recess 30 for the storage of additional blades. To facilitate this storage, an additional boss 32 is provided which is sized to accept the slot portion of the blades. This handle portion 24 is provided with a transverse bore 34 which is internally threaded.

FIG. 3B shows the interior surface of the left hand portion of the present invention. In the forward portion there is a recess 36 which will accept the boss 28 of the opposite side to facilitate holding the cutting blade in proper position. Alternatively, both of the handle portions can have boss members which meet at a median plane rather than the boss and recess as shown. The rearward portion of this left hand portion of the handle has a pair of bulkheads 38, 40 each of which, as shown in FIG. 5, has a raised central portion which fits within the recess 30 of the opposite side so that the raised central portions prevent rotation of one handle portion with respect to the other. Alternatively, only one bulkhead can be provided with the raised portion. The bulkheads furthermore hold any blades being stored therein in proper position within the handle. It will be understood that the present invention is not limited to this manner of preventing relative rotation of the handle portions when the halves are brought together with the thumbwheel. This left hand portion of the handle is provided with an aperture 42 which is unthreaded and which mates with the aperture 34 of the other handle half. It will be understood that a left-handed knife of the present invention can be fabricated by threading aperture 42 and eliminating the threads in aperture 34. The thumbwheel would then be positioned on the opposite side of the knife handle 12.

FIGS. 4 and 5 are cross-sectional views taken at 4—4 and 5—5, respectfully, of the carpet pad knife shown in FIG. 1. Since the components illustrated in these figures have already been described with reference to FIG. 3, no detailed discussion of these two figures is deemed necessary.

FIG. 6 illustrates the thumbwheel of the present invention as shown in FIGS. 1 and 2. This thumbwheel has an enlarged head portion 44 which preferably is chamfered and knurled such that a person using the knife and grasping the same in a hand can cause rotation of the thumbwheel in either direction with the thumb. Immediately below the head 44 is a annular boss 46 (or a thin washer) which bears against the exterior of the handle of the left hand portion of the present invention to reduce friction during rotation. Extending centrally from the head 44 is a shaft 48 with an unthreaded portion 49 which passes through the aforementioned aperture 42. Surrounding this shaft 48 is a loose washer-like element 50 which is held in place by a split ring 52. The remainder of the shaft 48 is threaded as at 54 for engagement with the threaded aperture 34 in the right hand half of the handle.

The construction of the thumbwheel unit is such that when the thumbwheel is rotated in a counterclockwise direction, the threaded portion 54 is unscrewed from threads in the aperture 34. Because of the washer 50 and split ring 52, the two portions of the knife are automatically separated as the threaded portion 54 "backs out" of the threaded aperture 34. When separation is sufficient to disengage the raised portion of the bulkheads 38, 40 from the recess 30, the two portions of the knife handle can be rotated around the axis of the shaft 48 allowing the removal of the spare knife blade from the recess 30 and the replacement (or reversal of cutting edges) of the knife blade 18 on the boss 28.

Shown in FIG. 7 is conventional blade for use in the present invention. It has double cutting edges as at 56, 58 with a central longitudinal slot 60 for securing in a manner described hereinabove. Such blades are state-of-the art and are used in many types of utility knives.

Figure 8:
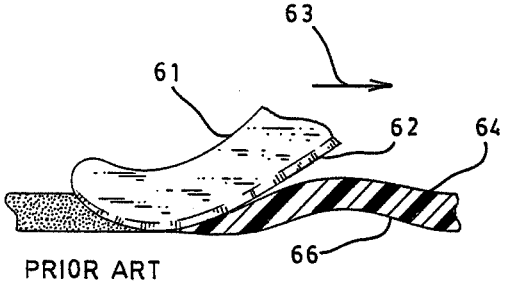
FIG. 8 is a fragmentary view of one carpet pad knife of the prior art illustrating the wrinkling of a carpet pad when cut with typical knives of the prior art.
Figure 9:
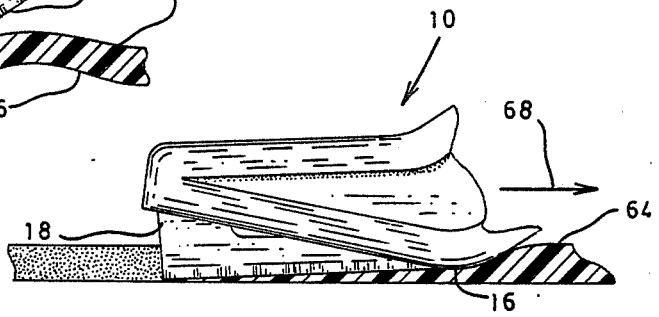
FIG. 9 is a drawing showing the slicing action of the present invention upon a carpet pad.

Referring now to FIGS. 8 and 9, shown therein are the relative cutting actions of a prior art carpet pad knife as compared to the present invention. The carpet pad knife as illustrated in FIG. 8 is one of several conventional (prior art) knives having an arcuate blade 61 with the cutting edge 62 provided thereon. This, and other typical knives of the prior art, are structured so that the cutting edge indicated at 62 is at a substantial angle to the top surface of a carpet pad 64. This results in a pulling action on the carpet pad during cutting in the direction indicated by the arrow 63 with the resultant wrinkling of the pad as illustrated at 66. This wrinkling results in a more tearing action of the carpet pad, and thus reduces the accuracy of any cutting. Furthermore, additional resistance to cutting adds fatigue to the user of the prior art knives.

In contrast, the present invention is illustrated in FIG. 9. The manner of support of the blade in the unit is such that movement of the cutting knife in a direction illustrated by arrow 68 causes a slicing action of the carpet pad 64 without any wrinkling thereof. Furthermore, the heel 16 of the handle (see FIG. 1) causes a compression of the carpet pad further assisting in this slice type cutting. This type of cutting reduces wear on the blade making the replacement thereof less frequent. Furthermore, less exertion is expended by the user of this knife, and thus the present invention reduces fatigue of a carpet installer.

From the foregoing, it can be seen than an improved carpet pad knife is provided by the construction illustrated in the attached figures. The reduction of fatigue to the user is particularly important to one who is employed as a carpet installer where several hours a day is involved in the cutting of carpet pads and then the carpets to be installed on the pad. If the blade becomes damaged or sufficiently dull, the two components of the handle are readily loosened and rotated through the use of the thumbwheel such that a new blade (or an alternate edge) is readily installed without the use of any additional tools.

Although described as a knife for cutting of carpet pad, the knife of the present invention can be used for other types of cutting operations where a slicing operation is preferred over a cutting action where the blade is at a substantial angle to the material being cut.

Although one embodiment of the present invention has been described and shown herein, it can be recognized that the invention is not limited to this one embodiment. Rather the invention is to be defined by the claims attached hereto and their equivalents.

I claim:

1. A knife for cutting carpet pad material without wrinkling said material during cutting, which comprises:

a handle unit, said handle unit having a rearward portion for grasp by a user of said knife, and a forward portion joined at a selected angle to said rearward portion at a heel, said handle divided into a pair of substantially mirror-image first and second side members divided at a median plane extending from said rearward portion to said forward portion, each said first and second side members defining an upper and a lower edge; a knife blade releasably held between said side members at said forward portion, said blade having a straight exposed cutting edge extending from proximate a forward extremity of said forward portion to proximate said heel for cutting said carpet pad material when said knife is moved toward said user, said blade held in said forward portion at an orientation whereby said cutting edge is aligned with said heel and disposed substantially parallel to said carpet pad material during cutting to achieve a slicing action when said rearward portion of said handle is at said selected angle to facilitate grasp of said handle by said user whereby said heel compresses said carpet pad material and said cutting edge slices said pad material without wrinkling thereof during use of said knife; and a thumbwheel unit for releasably fastening said side members in side-by-side alignment, said thumbwheel unit having a shaft substantially perependicular with said median plane and a thumbwheel attached to one end of said shaft exterior one of said side members, said thumbwheel extending at least to said upper edge of said first side member to be readily accessible for rotation by a thumb of said user, said shaft penetrating and being rotatable in said first side member adjacent said thumbwheel and threadably engaged with said second of said side members, said shaft provided with an encircling captive washer axially positioned at said median plane whereby counterclockwise rotation of said thumbwheel and said shaft by said user causes said captive washer to move said first side member away from said second member to release said blade from between said side members.

2. The knife of claim 1 wherein said selected angle is about 30 to 45 degrees with respect to a long axis of said rearward portion.

3. The knife of claim 2 wherein said knife blade is provided with an elongated slot and at least one of said side members is provided with an elongated boss at said median plane of said forward portion to engage said slot of said blade to grasp said blade and align said cutting edge with said heel.

4. The knife of claim 3 wherein one of said first and second side members is provided with a recess at said median plane for storage of replacement blades each having an elongated slot, said recess having a centrally positioned boss to engage said slots of said replacement blades.

5. The knife of claim 4 wherein said side member opposite said side member provided with said recess has at least one bulkhead with a central portion extending beyond said median plane, said extending central portion being received in said recess to prevent relative rotation between said first and second side members when said side members meet at said median plane.

6. A knife for cutting carpet pad material without wrinkling said material during cutting, which comprises:

a handle unit, said handle unit having a rearward portion for grasp by a user of said knife, and a forward portion oriented at an angle of about 30 to 45 degrees with respect to the long axis of said rearward portion, said forward portion meeting said rearward portion at a heel, said handle divided into a pair of substantially mirror-image first and second side members divided at a median plane extending from said rearward portion to said forward portion, at least one of said side members at said forward portion provided at said median plane with a boss to be received in a longitudinal slot of a cutting blade;

a knife blade releasably held between said side members at said forward portion and engaged with said boss, said blade having an exposed straight cutting edge aligned with and extends proximate said heel for cutting said carpet pad material when said knife is moved toward said user, said blade held in said forward portion at an orientation whereby said cutting edge is disposed substantially parallel to said carpet pad material during cutting to achieve a slicing action when said rearward portion of said handle is at an angle to said carpet pad material to facilitate grasp of said handle by said user, a thumbwheel unit for releasably fastening said side members in side-by-side alignment, said thumbwheel unit having a shaft substantially perpendicular with said median plane and a thumbwheel attached to one end of said shaft, said shaft penetrating and being rotatable in said first side member adjacent said thumbwheel and threadably engaged with said second of said side members, said shaft provided with an encircling captive washer axially positioned at said median plane whereby counterclockwise rotation of said shaft causes said washer to move said first side member away from said second member to release said blade from between said side members; and wherein one of said first and second side members is provided with a recess at said median plane for storage of replacement blades each having an elongated slot, said recess having a centrally positioned boss to engage said slots of said replacement blades, and wherein said side member opposite said side member provided with said recess has at least one bulkhead with a central portion extending beyond said median plane, said extending central portion being received in said recess to prevent relative rotation between said first and second side members when said side members meet at said median plane.

7. A knife for cutting carpet pad material without wrinkling said material during cutting, which comprises:

a handle unit, said handle unit having a rearward portion for grasp by a user of said knife, and a forward portion joined at a selected angle to said rearward portion at a heel, said handle divided into a pair of substantially mirror-image first and second side members divided at a median plane extending from said rearward portion to said forward portion, one of said first and second side members being provided with a recess at said median plane and said side member opposite said side member provided with said recess being provided with at least one bulkhead with a central portion extending beyond said median plane, said extending central portion being received in said recess to prevent relative rotation between said first and second side members when said side members meet at said median plane;

a knife blade releasably held between said side members at said forward portion, said blade having an exposed cutting edge aligned with and extending proximate said heel for cutting said carpet pad material when said knife is moved toward said user, said blade held in said forward portion at an orientation whereby said cutting edge is disposed substantially parallel to said carpet pad material during cutting to achieve a slicing action when said rearward portion of said handle is at said selected angle to facilitate grasp of said handle by said user; and a thumbwheel unit for releasably fastening said side members in side-by-side alignment, said thumbwheel unit having a shaft substantially perpendicular with said median plane and a thumbwheel attached to one end of said shaft, said shaft penetrating and rotatable in said first side member adjacent said thumbwheel and threadably engaged with said second of said side members, said shaft provided with an encircling washer axially positioned at said median plane whereby counterclockwise rotation of said shaft causes said washer to move said first side member away from said second member to release said central portion of said bulkhead from said recess and permit rotation of said first side portion relative to said second portion about said shaft for removal of said knife blade from between said side members.

8. The knife of claim 7 wherein said recess is provided for storage of replacement knife blades each having an elongated slot, said recess having a centrally positioned boss to engage said slots of said replacement knife blades.

* * * * *